US007595731B1

(12) United States Patent
Tang

(10) Patent No.: US 7,595,731 B1
(45) Date of Patent: Sep. 29, 2009

(54) IC PACKAGE ANTENNA

(75) Inventor: Chia-Lun Tang, Pa-Te (TW)

(73) Assignee: Auden Techno Corp., Pa-Te (TW)

( * ) Notice: Subject to any disclaimer, the term of this patent is extended or adjusted under 35 U.S.C. 154(b) by 21 days.

(21) Appl. No.: 12/127,041

(22) Filed: May 27, 2008

(51) Int. Cl.
*G08B 13/14* (2006.01)

(52) U.S. Cl. ..... 340/572.1; 340/572.5; 343/700 MS

(58) Field of Classification Search ..... 343/700 MS, 343/702, 873; 340/572.1, 572.5, 572.8, 10.1, 340/10.4
See application file for complete search history.

(56) References Cited

U.S. PATENT DOCUMENTS 6,249,227 B1 * 6/2001 Brady et al. ..... 340/572.1
6,849,936 B1 * 2/2005 Berman et al. ..... 257/679
7,518,553 B2 * 4/2009 Zhang et al. ..... 343/700 MS
2005/0090300 A1 * 4/2005 Zhang et al. ..... 455/575.7
2007/0120742 A1 * 5/2007 Soler Castany et al. ..... 343/700 MS

* cited by examiner

*Primary Examiner*—Tho G Phan
(74) *Attorney, Agent, or Firm*—Ming Chow; Sinorica, LLC

(57) ABSTRACT

An IC package antenna of which a metal radiating member is firstly provided on a base board to form an antenna base board; the antenna base board is formed thereon at least a feed point; and the IC package antenna is packaged with an IC packaging housing and a packaging bottom portion to form an IC chip. The IC packaging housing has a plurality of connecting pins extending outward from inside of itself; wherein the inner end of at least one connecting pin is soldering connected with a feed point of the base board of the antenna. Such an IC package antenna can allow standardized and miniaturized antenna designing, and is applicable to Surface Mount Technology (SMT).

6 Claims, 6 Drawing Sheets

IC PACKAGE ANTENNA

BACKGROUND OF THE INVENTION

1. Field of the Invention

The present invention relates to an IC package antenna, and especially to an antenna formed by packaging an antenna base board with a housing of an integrated circuit, this allows standardized and miniaturized antenna designing, and is applicable to Surface Mount Technology (SMT).

2. Description of the Prior Art

An antenna is a necessary element for a set of communication equipment, and it is a technique pursued by the art to provide a good antenna structure for use under the requirement of miniaturization and compactness for portable wireless communication equipment.

Installing of electronic elements on a print circuit board normally is performed by Surface Mount Technology (SMT), the way mainly is to print tin paste on the print circuit board, and after electronic parts of a Surface Mount Device (SMD) are placed at correct positions, the tin paste is molten by reflowing to make soldering combining of the electronic parts with the print circuit board; such a technique of combining is not available easily for a conventional antenna, in view of this, it is the subject of the present invention to provide a brand new antenna structure in accompany with applying of Surface Mount Technology (SMT).

SUMMARY OF THE INVENTION

The present invention provides an IC package antenna to get rid of the problem resided in the conventional technique, firstly a metal radiating member is provided on a base board to form an antenna base board; the antenna base board is packaged with an IC packaging housing and a packaging bottom portion to form an IC chip. The IC packaging housing has a plurality of connecting pins extending outward from inside of itself, wherein the inner end of one connecting pin is soldering connected with a feed point of the base board of the antenna.

The IC package antenna provided in the present invention can allow standardized and miniaturized antenna designing, and is applicable to Surface Mount Technology (SMT).

The IC package antenna provided in the present invention can further be integrated with a set of radio frequency elements on the base board of the antenna.

The present invention will be apparent in its structure and characteristics after reading the detailed description of the preferred embodiment thereof in reference to the accompanying drawings.

DETAILED DESCRIPTION OF THE PREFERRED EMBODIMENT

Figure 1:
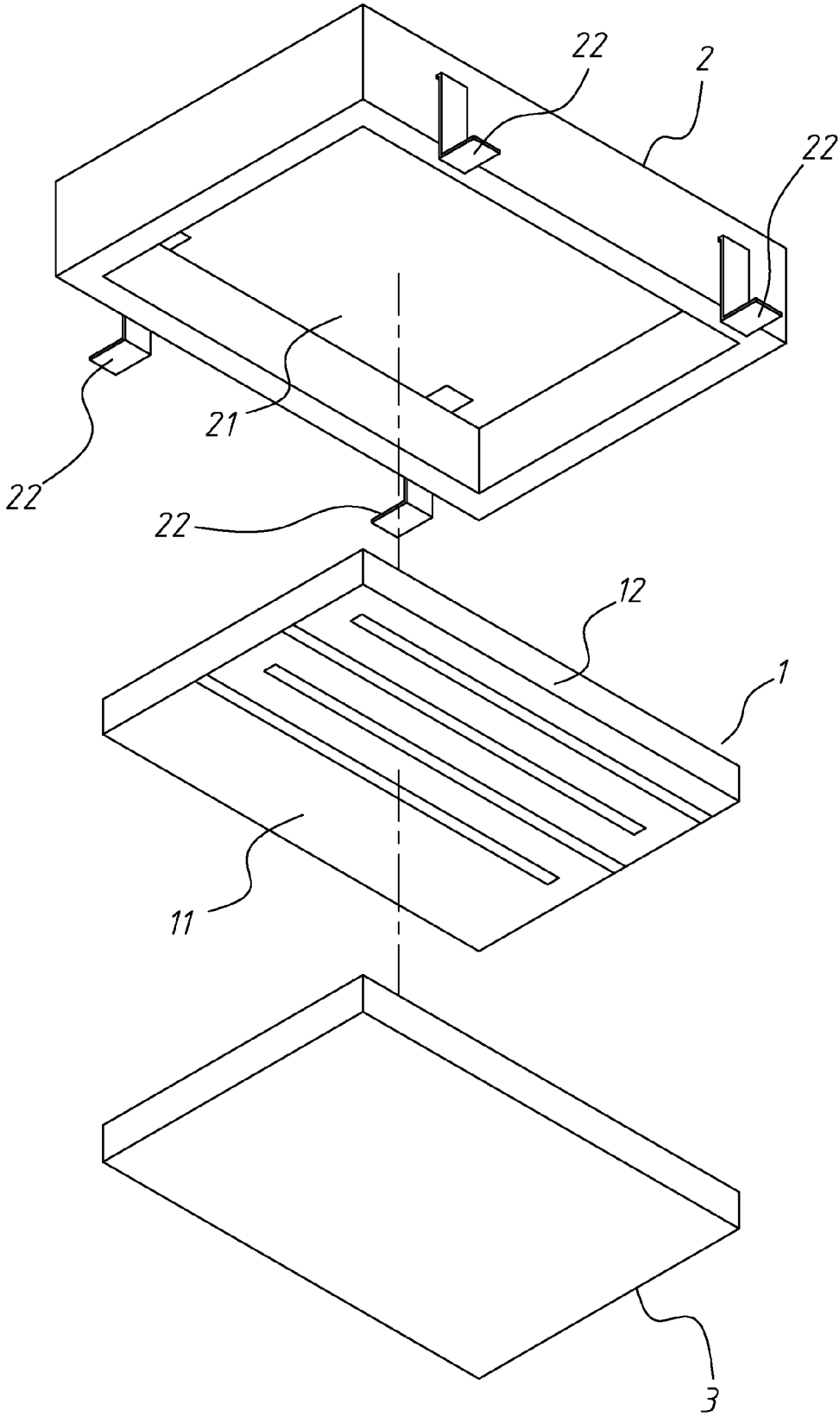
FIG. 1 is an exploded perspective view of the present invention.
Figure 2:
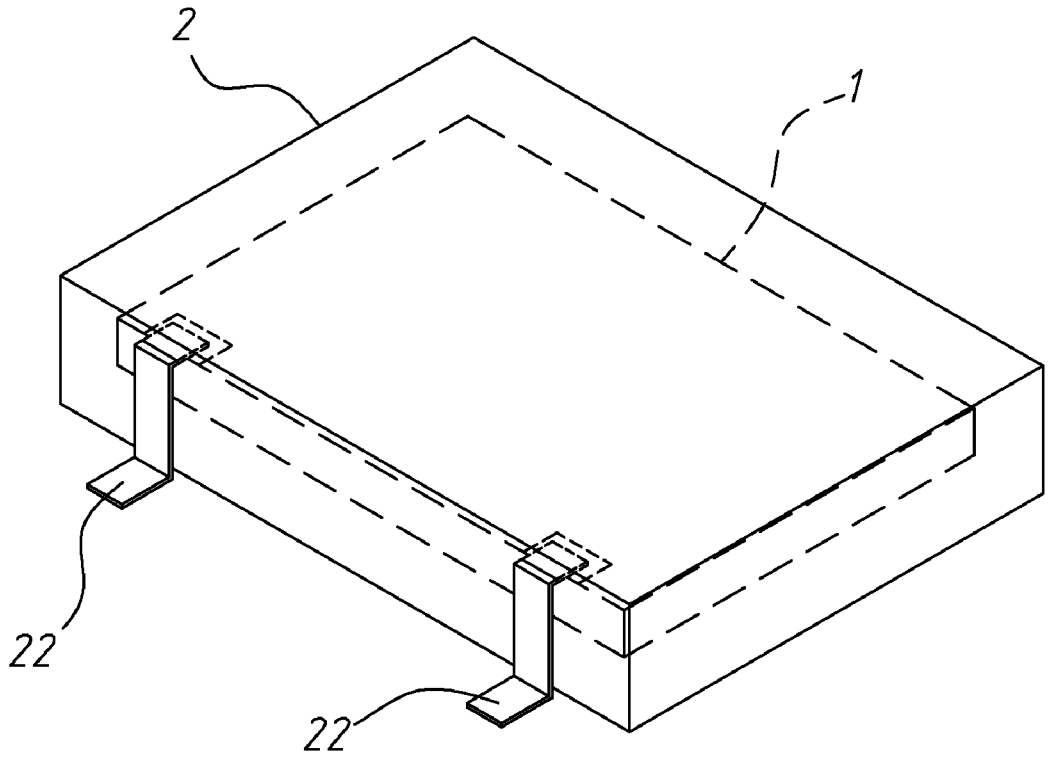
FIG. 2 is a perspective view of the present invention after assembling.
Figure 3:
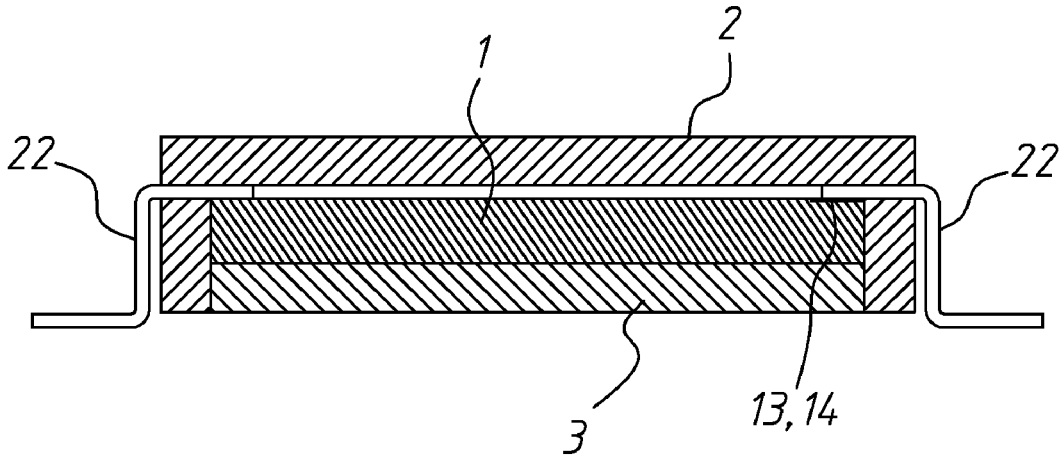
FIG. 3 is a sectional view of the present invention.

Referring to FIGS. 1 to 3, an IC package antenna of the present invention comprises in its structure an antenna base board 1, an IC packaging housing 2 and a packaging bottom portion 3.

Figure 1A:
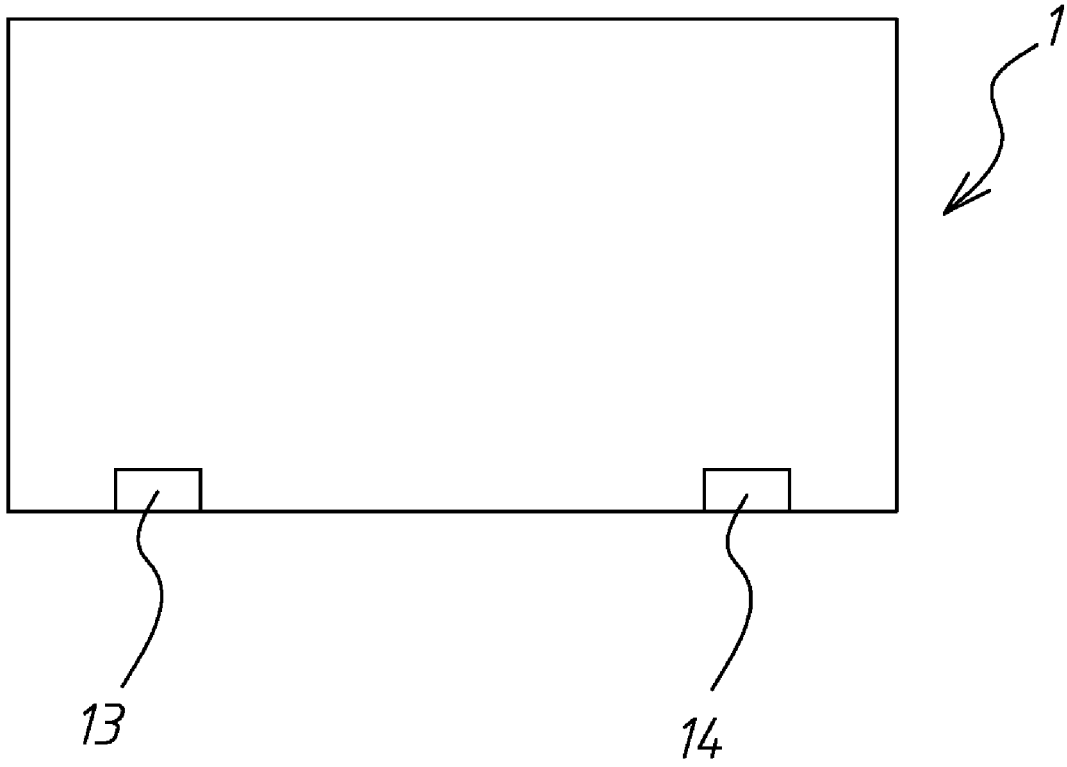
FIG. 1A is a top view of an antenna base board of the present invention.

The antenna base board 1 of the present invention has a metal radiating member 11 provided on a base board 12, the base board 12 is formed thereon a feed point 13 and a circuit shorting point 14; referring to FIG. 1A, the feed point 13 and the circuit shorting point 14 can be provided on another surface of the base board 12 in opposition to the metal radiating member 11, while the base board 12 can be a microwave base board or a ceramic base board.

The IC packaging housing 2 is formed therein a receiving space 21 to receive the antenna base board 1. A plurality of connecting pins 22 are extended outwards from the interior of the housing 2, in which inner ends of two connecting pins 22 are soldering connected with the feed point 13 and the circuit shorting point 14 of the antenna base board 1 (please refer to FIG. 3), while other two connecting pins 22 are used as fixed connecting pins for supporting. The packaging bottom portion 3 covers the bottom of the IC packaging housing 2 to completely package the antenna base board 1.

The IC package antenna provided in the present invention packages the radiating member of the antenna to become an IC chip having the function of an antenna by using the packaging process for IC, this can meet the requirement of standardization and miniaturization for an antenna; and by using the connecting pins to make fixing of position, thus an SMD is formed that can be applied to SMT.

Figure 4:
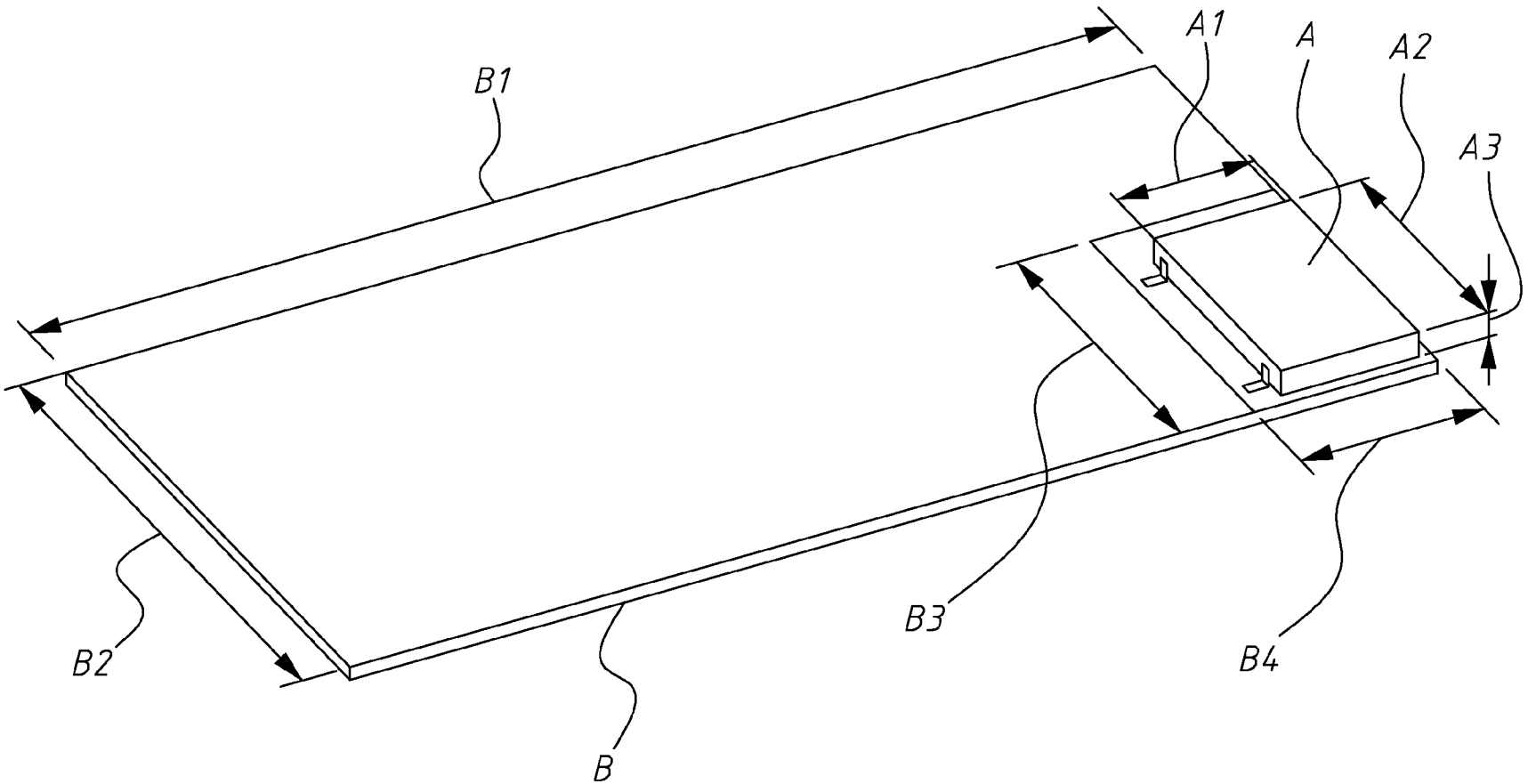
FIG. 4 is an environment test chart of an embodiment of antenna of the present invention formed by placing the embodiment of antenna on an electric circuit board B.

And more, please refer to FIG. 4, in which an embodiment of IC package antenna A of the present invention is placed on an electric circuit board B to form an antenna test environment. In the antenna test environment, data of size of the IC package antenna A are as follows:

A1=12.5 mm

A2=18 mm

A3=2.5 mm

While data of size of the grounding surface of the electric circuit board

B are as follows:

B1=107 mm

B2=40 mm

B3=25 mm

B4=17 mm

Figure 6:
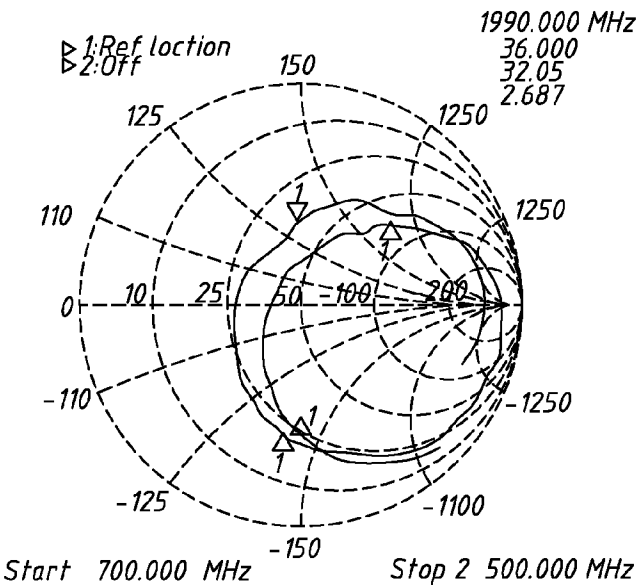
FIG. 6 is a Smith chart showing the result of test on the embodiment of antenna of the present invention.
Figure 5:
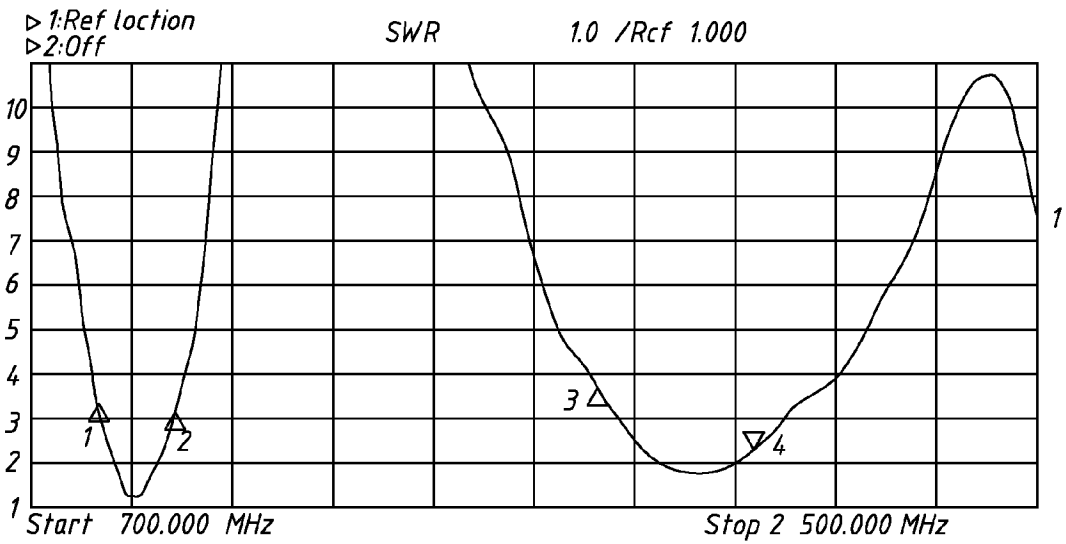
FIG. 5 is a chart showing the result of VSWR test on the embodiment of antenna of the present invention.

FIGS. 5 and 6 show the results of tests on the embodiment of the present invention, in which we can see the efficiencies of the antenna:

| Frequency (MHz) | 824 | 880 | 960 | 1710 | 1880 | 1990 | 2170 |
|---|---|---|---|---|---|---|---|
| 3D gain (dBi) | −4.67 | −3.27 | −5.81 | −3.30 | −2.23 | −2.44 | −4.68 |
| Efficiency % | 28.88 | 48.46 | 43.46 | 51.03 | 51.84 | 60.65 | 34.03 |

Therefore we can see from above that the present invention provides a good design of antenna.

Figure 7:
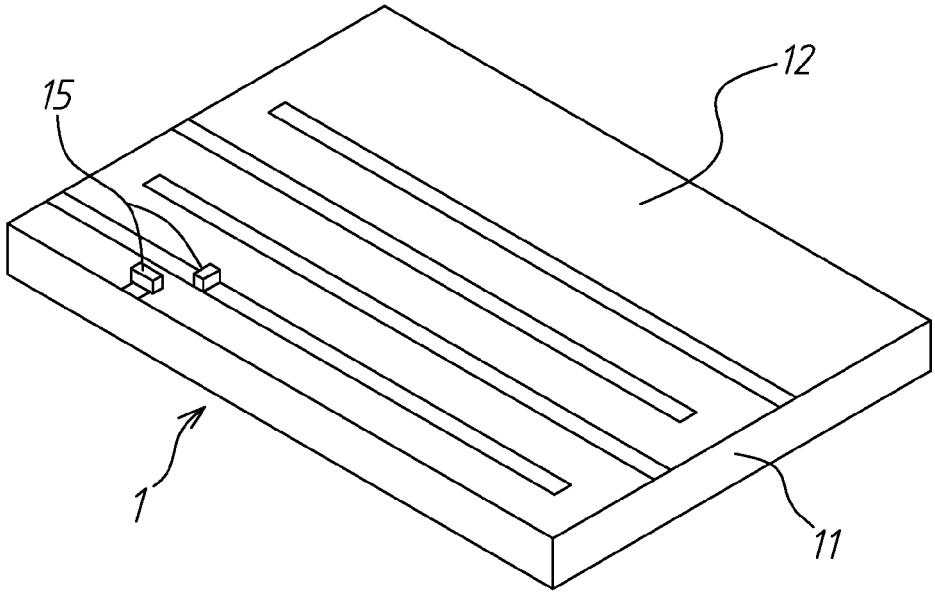
FIG. 7 is a perspective view showing the appearance of another embodiment of antenna base board of the present invention, the antenna base board is provided thereon with a matched circuit (that can adjust the impedance characteristic of the antenna) formed from radio frequency electric circuit elements.

Referring to FIG. 7, in the present invention, the antenna base board 1 is integrated thereon with a set of radio frequency circuit elements 15 to form a matched circuit that can adjust the impedance characteristic of the antenna, the radio frequency circuit elements 15 each can be a chip capacitor and/or a chip electric inductor.

Figure 8:
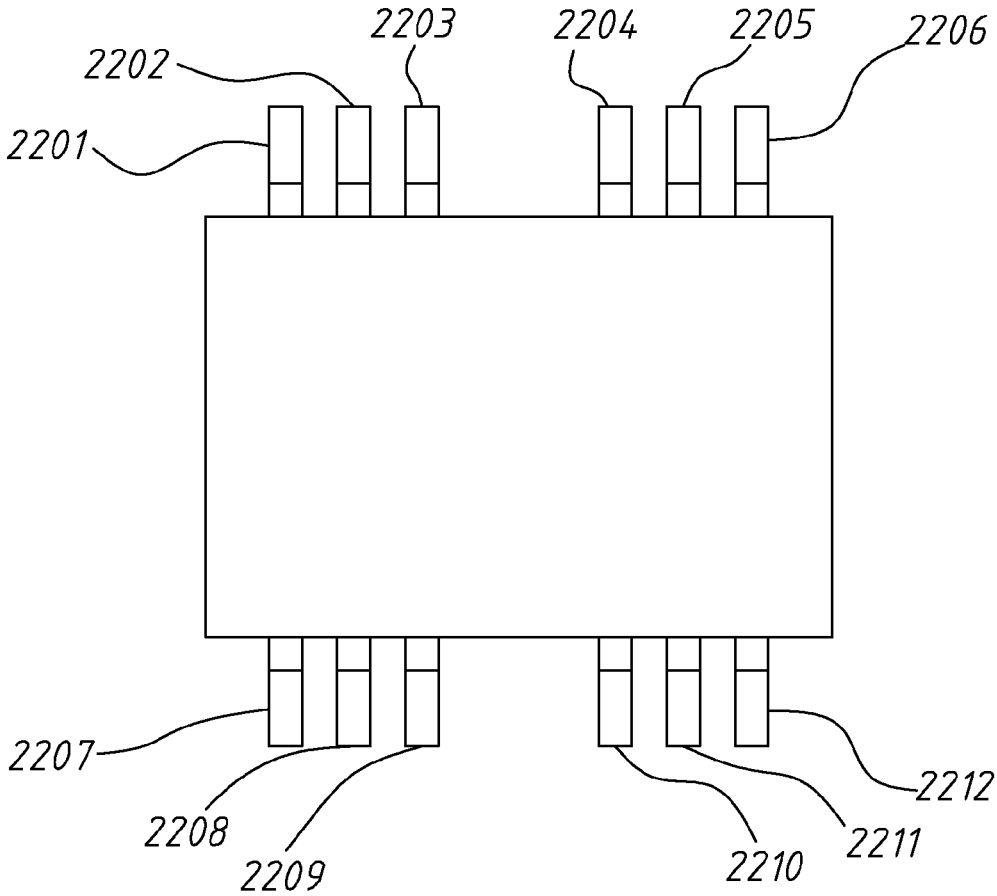
FIG. 8 is a plane view of an embodiment of the present invention having multiple pins embodiment; these multiple pins are applied to different ranges of frequency bands for operation.

With such a design, the IC package antenna can have multiple working frequency bands. Referring to FIG. 8, the IC package antenna has multiple connecting pins 2201~2212 for being operated with various frequency bands. For example:

connecting pin 2201 is WLAN;
connecting pin 2202 is BT;
connecting pin 2203 is a fixed connecting pin;
connecting pin 2204 is a fixed connecting pin;
connecting pin 2205 is WLAN;
connecting pin 2206 is UWB;
connecting pin 2207 is GSM 4-band;
connecting pin 2208 is DCS/PCS;
connecting pin 2209 is a fixed connecting pin;
connecting pin 2210 is a fixed connecting pin;
connecting pin 2211 is WCDMA;
connecting pin 2212 is GPS.

Having thus described my invention having high industrial value, what I claim as new and desire to be secured by Letters Patent of the United States is:

1. An IC package antenna comprising:

an antenna base board on which a metal radiating member is provided, said antenna base board being formed thereon at least a feed point;

an IC packaging housing being formed therein a receiving space to receive said antenna base board, a plurality of connecting pins being extended outwards from interior of said IC packaging housing, in which an inner end of one of a couple of connecting pins being soldering connected with said feed point; and a packaging bottom portion covering a bottom of said IC packaging housing to completely package said antenna base board.

2. The IC package antenna as defined in claim 1, wherein said antenna base board is a microwave base board or a ceramic base board.

3. The IC package antenna as defined in claim 2, wherein said antenna base board is integrated with a set of radio frequency circuit elements to form a matched circuit to adjust impedance characteristic of said IC package antenna.

4. The IC package antenna as defined in claim 3, wherein said radio frequency circuit elements each is a chip capacitor and/or a chip electric inductor.

5. The IC package antenna as defined in claim 4, wherein said connecting pins of said IC package housing are provided for being operated with various frequency bands.

6. The IC package antenna as defined in claim 1, wherein said antenna base board has a circuit shorting point, wherein an inner end of other one of said couple of connecting pins of said IC packaging housing is soldering connected with said feed point of said antenna base board.

* * * * *